United States Patent [19]

Akiyama et al.

[11] Patent Number: 4,671,242

[45] Date of Patent: Jun. 9, 1987

[54] ENGINE CONTROL APPARATUS

[75] Inventors: Susumu Akiyama, Kariya; Katsunori Ito; Yuzi Hirabayashi, both of Aichi; Masumi Kinugawa, Okazaki; Norio Omori, Kariya, all of Japan

[73] Assignee: Nippondenso Co., Ltd., Kariya, Japan

[21] Appl. No.: 736,373

[22] Filed: May 21, 1985

[30] Foreign Application Priority Data

May 22, 1984 [JP] Japan ..... 59-103038

[51] Int. Cl.[4] ..... F02D 41/18

[52] U.S. Cl. ..... 123/486; 123/488; 123/494; 364/431.05

[58] Field of Search ..... 123/480, 486, 494, 488; 364/431.05

[56] References Cited

U.S. PATENT DOCUMENTS

| | | | |
|---|---|---|---|
| 3,969,614 | 7/1976 | Moyer et al. | 123/486 |
| 4,058,089 | 11/1977 | Schmidt et al. | 123/494 |
| 4,089,214 | 5/1978 | Egami et al. | 73/116 |
| 4,304,129 | 12/1981 | Kawai et al. | 73/204 |
| 4,476,831 | 10/1984 | Shinoda et al. | 123/480 |

FOREIGN PATENT DOCUMENTS

| | | |
|---|---|---|
| 0070801 | 1/1983 | European Pat. Off. . |
| 2230992 | 12/1974 | France . |
| 2465081 | 3/1981 | France . |
| 55-104538 | 8/1980 | Japan . |
| 56-51618 | 5/1981 | Japan . |
| 58-95214 | 6/1983 | Japan . |
| 2033003 | 5/1980 | United Kingdom . |

*Primary Examiner*—Andrew M. Dolinar

*Attorney, Agent, or Firm*—Cushman, Darby & Cushman

[57] ABSTRACT

An engine control apparatus has an air flow rate measuring device for measuring an intake air flow rate. A temperature sensing element having a temperature characteristic and constituting the device is arranged in an intake pipe. The device generates an output pulse signal having a pulse width T corresponding to the intake air flow rate. An engine control unit has the one-dimensional map for storing the relationship between the engine speed N and the pulse width to of the signal corresponding to the air flow rate. This data to is read out from the one-dimensional map in accordance with the engine speed N. Subsequently, the data to is subtracted from the data T to calculate a time duration t. The unit also has a two-dimensional map for storing the relationship between each time duration t and the corresponding rate G/N in correspondence with each of the present engine speeds. A corresponding rate G/N is read out from the two-dimensional map in response to the calculated time duration t. The resultant rate G/N is used to calculate fuel injection quantity.

15 Claims, 14 Drawing Figures

FIG. 4
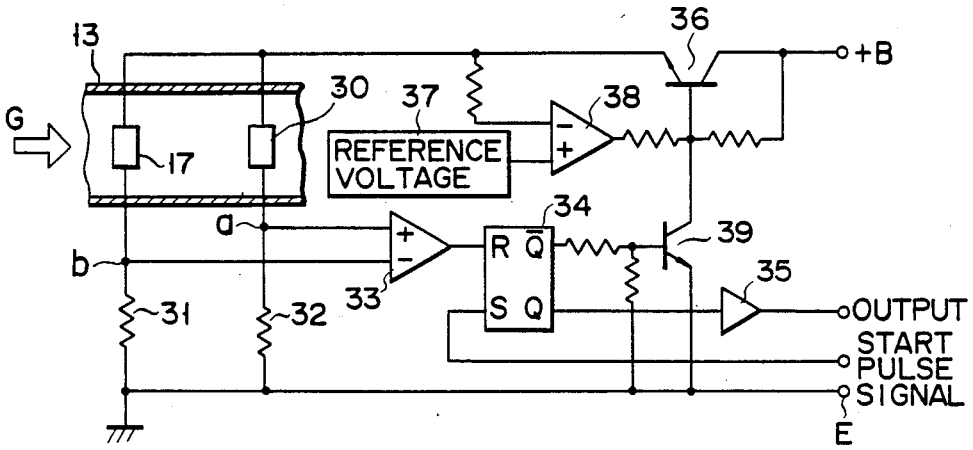
FIG. 5A
FIG. 5B
FIG. 5C
FIG. 5D
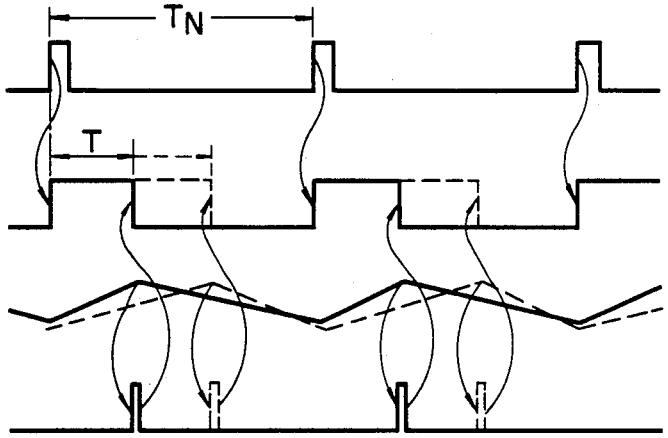

ENGINE CONTROL APPARATUS

BACKGROUND OF THE INVENTION

The present invention relates to an engine control apparatus and, more particularly, to an electronic control apparatus using, for example, a microcomputer so as to effectively perform control operations such as arithmetic control of fuel injection quantity.

When an engine is controlled by a conventional electronic control apparatus using a microcomputer, the operating state of the engine is always monitored, and the proper fuel injection quantity corresponding to the operating state is calculated to control fuel injection.

Conventional means such as an engine speed sensor, an engine temperature sensor and a throttle valve opening sensor are used to monitor engine operating states. In addition, an intake air flow measuring unit is known, and is a device directly associated with an arithmetic operation of fuel injection quantity. Such a device is exemplified by a heat wire type air flow sensor. This sensor comprises a temperature sensing element arranged in an intake pipe and controlled by heating power. The element radiates heat due to the air flow in the intake pipe. Therefore, when the temperature sensing element is energized, its temperature characteristics correspond to an intake air flow rate.

An electronic engine control unit comprises, for example, a microcomputer. In order to calculate the proper fuel injection quantity corresponding to a given engine operating state in such a control unit, it is desirable that an engine operating state detection signal supplied thereto be digital data. Accordingly, it is also desirable that the air flow rate signal from the air flow rate measuring unit be a digital signal.

In view of this, it is proposed to obtain an air flow rate signal as a pulse signal and represent a measured air flow rate by a pulse width of the pulse signal. When such a signal is given, the intake air flow rate can be numerically detected by counting clock pulses representing the pulse width. The resultant digital data can be effectively utilized for arithmetic control in the microcomputer.

SUMMARY OF THE INVENTION

It is an object of the present invention to provide an engine control apparatus wherein an engine control unit constructed, for example, by a microcomputer can effectively perform arithmetic control of e.g. fuel injection quantity, based on the detection of the intake conditions such as the intake flow rate.

It is another object of the present invention to provide an engine control apparatus wherein an engine control unit constructed, for example, by a microcomputer can effectively perform arithmetic control by digitally displaying intake condition data.

It is still another object of the present invention to provide an engine control apparatus wherein a microcomputer control program can be greatly simplified and engine control can be performed with high precision when an intake air flow rate signal as a pulse signal is supplied to the microcomputer to calculate fuel injection quantity or the like.

It is still another object of the present invention to provide an arrangement wherein an intake air flow rate G/N (G: the air flow amount, and N: the number of engine rotations per unit of time) can be calculated to obtain engine control data such as fuel injection quantity data or the like, thereby performing arithmetic control of the engine.

According to the engine control apparatus of the present invention, there is provided an intake condition measuring device used for detecting the conditions of the intake air flow rate of the engine. This device is constructed, for example, in the following manner. A temperature sensing element having a resistance variation characteristic depending on a change in temperature in the air intake pipe is arranged therein to constitute an air flow sensor. The temperature sensing element is heated by heating power rising in synchronism with engine rotation. When the temperature sensing element is heated to a predetermined temperature, power thereto is turned off. A pulse signal representing the pulse width of the heating power supplied to the temperature sensing element is generated as a measurement signal having a pulse width T. In addition, a pulse width t0 of the air flow rate signal at a specified G/N value is stored using N as a parameter in a one-dimensional map. Data of a relationship between the intake air flow rate G/N and a time duration t is stored in a two-dimensional map so as to correspond to a specific value of N. The pulse width t0 is read out from the one-dimensional map in response to the corresponding value of N, and a calculation is performed using the corresponding pulse width T such that "$T-t0=t$". The data G/N is read out from the two-dimensional map in response to the resultant time duration t. Engine control data such as fuel injection quantity data and ignition timing data is calculated in accordance with the readout data G/N.

The engine control data such as fuel injection quantity data can be easily calculated by effectively using the measurement output signal generated from the air flow rate measuring unit for converting an intake air flow rate to a pulse width. In particular, since the rate G/N can be easily read out from the two-dimensional map in response to simple calculation results based on data accessed from the one-dimensional map using the engine speed as a parameter, the arrangement and operating control of the engine control system can be simplified.

BRIEF DESCRIPTION OF THE DRAWINGS

FIG. 4 is a circuit diagram of the air flow rate measuring unit;

FIGS. 5A to 5D are respectively timing charts for explaining the operation of the air flow rate measuring unit;

DETAILED DESCRIPTION OF THE PREFERRED EMBODIMENT

Figure 1:
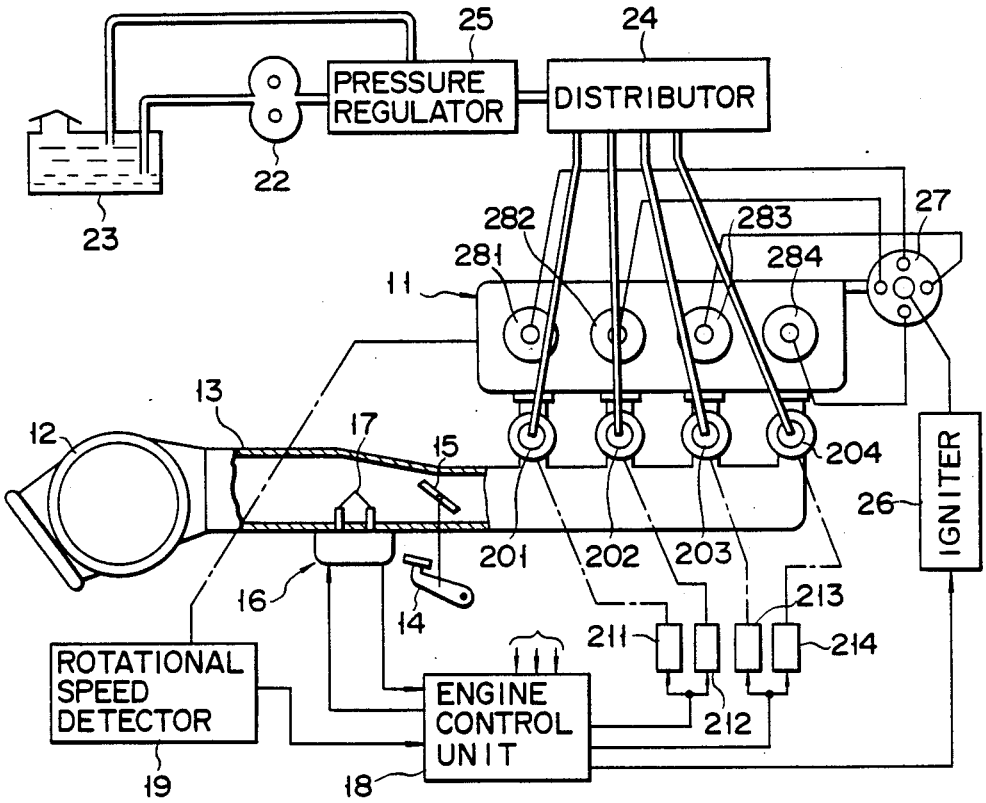
FIG. 1 is a schematic diagram showing an engine control system for explaining an engine control apparatus according to an embodiment of the present invention.

FIG. 1 shows a control system of an engine 11. In this control system, a proper fuel injection quantity for a given operating state of the engine 11 is electronically calculated, and fuel is injected into the engine according to the calculated fuel injection quantity.

Intake air for the engine 11 is sucked through an air filter 12 and is supplied to the engine 11 through an intake pipe 13. The intake air is supplied to a plurality of cylinders of the engine 11 through a throttle valve 15 driven by an accelerator pedal 14. A temperature sensing element 17 as an air flow rate sensor in a heat wire type air flow rate measuring device 16 is arranged inside the intake pipe 13. The temperature sensing element 17 is heated by a heating current and comprises, for example, a platinum wire heater having a resistance variation characteristic in response to a change in temperature.

An air flow rate signal from the device 16 is supplied to an engine control unit 18 constituted by a microcomputer. The element 17 is supplied with the heating current in response to an instruction generated from the unit 18.

The unit 18 also receives as operating state detection signals an output signal from a rotational speed detector 19 for detecting the speed of the engine 11, a cooling water detection signal for the engine 11 and an air-fuel ratio signal (not shown). The unit 18 calculates the optimal fuel injection quantity corresponding to the operating state of the engine 11 on the basis of the above detection signals. The unit 18 then commonly supplies a fuel injection time width signal to fuel injectors 201 to 204 of the cylinders of the engine 11 through respective resistors 211 to 214. It should be noted that the mixture at a predetermined injection pressure is supplied to the injectors 201 to 204, so that only the opening time of the injectors need be controlled by the injection time width signal so as to control the injection quantity.

Fuel from a fuel tank 23 is supplied by a fuel pump 22 to the injectors 201 to 204 through a distributor 24. The pressure of the fuel supplied to the distributor 24 is controlled by a pressure regulator 25 to be constant, so that the injection quantity can be accurately controlled in accordance with the opening time of the injectors.

The unit 18 also supplies an instruction to an igniter 26 and causes the distributor 27 to supply ignition signals to spark plugs 281 to 284 in the cylinders of the engine 11. The ignition timings are determined in accordance with the operating state represented by the detection signals described above, thereby controlling the operation of the engine 11.

Figure 2:
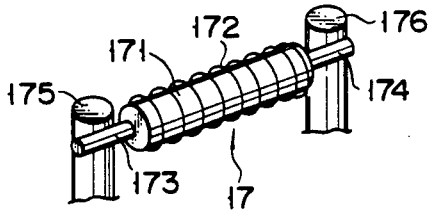
FIGS. 2 and 3 are respectively perspective views of temperature sensing elements each constituting an air flow rate measuring unit used in the engine control system of FIG. 1.

FIG. 2 shows the temperature sensing element 17 in the device 16 used in the above-mentioned engine control system. A platinum resistive wire 172 having a temperature characteristic is wound around a ceramic bobbin 171. Conductive shafts 173 and 174 as support shafts extend at two ends of the bobbin 171 and are supported by conductive pins 175 and 176, respectively. Heating power is supplied to the wire 172 through the pins 175 and 176. A portion of the element 17 which corresponds to the wire 172 is exposed to the air flow in the pipe 13.

Figure 3:
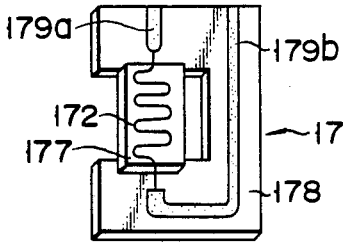

FIG. 3 shows another temperature sensing element 17. A resistive wire 172 serving as a heater having a temperature characteristic is formed by printing on an insulating film 177. The film 177 is supported by an insulating support substrate 178. Wires **179*a* and 179*b* are formed on the surface of the substrate 178 and connected to the wire 172. Heating power is thus supplied to the wire 172 through the wires 179*a* and 179*b***.

FIG. 4 is a circuit diagram of the air flow rate measuring unit 16. The element 17 is fixed inside the pipe 13, and an auxiliary temperature sensing element 30 is also arranged therein. The element 30 comprises a resistive wire such as a platinum wire having the same temperature characteristic as the element 17. The resistance of the element 30 changes in accordance with a change in temperature of air flowing through the pipe 13, so that the element 30 serves as an air temperature measuring means. The elements 17 and 30 and fixed resistances 31 and 32 constitute a bridge circuit. A junction a between the element 17 and the resistor 31 and a junction b between the element 30 and the resistor 32 are connected to the inverting and noninverting input terminals of a comparator 33, respectively. When the temperature of the element 17 is higher than the air temperature detected by the element 30 by a predetermined temperature, the comparator 33 generates an output signal.

The output signal from the comparator 33 resets a flip-flop 34. The flip-flop 34 is set in response to a start pulse signal. This state pulse signal is supplied from the unit 18 which is not illustrated in FIG. 4. The unit 18 detects a signal generated by the rotational speed sensor 19 when the engine 11 rotates once, and generates a start pulse signal in response to this signal.

The flip-flop 34 is set in a mode synchronized with the rotation of the engine 11 and reset when the temperature of the element 17 is increased to a specific temperature. The flip-flop 34 generates a pulse signal having a pulse width corresponding to a time interval between setting and resetting. The output signal from the flip-flop 34 is supplied as an output signal of the measuring unit through a buffer amplifier 35.

A transistor 36 controls the ON/OFF state of power supplied to the bridge circuit including the element 17 in the following manner. A differential amplifier 38 applied with a reference voltage from a reference voltage source 37 monitors the voltage to be applied to the bridge circuit. An output from the amplifier 38 controls the base voltage of the transistor 36. The power supplied to the bridge circuit is used as the heating power for the element 17.

The base of the transistor 36 is grounded through a transistor 39. The transistor 39 is turned on when the flip-flop 34 is reset. The transistor 36 is turned off when the flip-flop 34 is set, thereby supplying heating power to the element 17.

When the start pulse signal shown in FIG. 5A is generated in synchronism with rotation of the engine 11, the flip-flop 34 is set and an output signal from a set terminal Q of the flip-flop 34 rises, as shown in FIG. 5B. The transistor 36 is turned on at the leading edge of the signal shown in FIG. 5B, and heating power at a constant voltage is supplied to the element 17. In this state, the element 17 is heated, and its temperature is increased as shown in FIG. 5C. In this case, the temperature rise rate of the element 17 is determined by a heat radiation effect thereof caused by an air flow acting thereon. More specifically, when an air flow rate is high, the temperature rise rate is low; however, when the air flow rate is low, the temperature rise rate is high.

When the temperature of the element 17 is increased, its resistance is accordingly increased. In this state, a voltage at the junction a is lower than that at the junction b, so that an output signal from the comparator 33 rises. In other words, when a difference between the temperature of the element 17 and the air temperature detected by the element 30 exceeds a specific difference, the output signal generated from the comparator 33 rises, as shown in FIG. 5D. This signal resets the flip-flop 34. The transistor 36 is turned off in response to the resetting of the flip-flop 34, thereby deenergizing the element 17.

In this manner, heating power is supplied to the element 17 for a time interval in which the element 17 is heated to a specific temperature. The time interval, i.e., the pulse width signal is generated as the output signal from the flip-flop 34. The temperature rise rate of the element 17 corresponds to a change in air flow in the pipe 13, so that the set time interval of the flip-flop 34 represents an air flow rate. Therefore, the output signal from the flip-flop 34, as shown in FIG. 5B, serves as the air flow rate signal representing the air flow rate in the pipe 13.

The output signal from the air flow rate measuring unit can be defined by a pulse width T and a period $T_N$ and is supplied to the unit 18 so as to calculate the fuel injection quantity or the like.

The pulse width T of the pulse signal corresponding to the measured air flow rate is represented by:

$$V \cdot i = h \cdot A(T_H - T_A)$$

$$V = i_o \cdot R_H$$

$$h = \alpha + \beta\sqrt{G}$$

$$\overline{i} = io(T/T_N)$$

for $T_N \propto 1/N$
therefore, $$(V^2/R_H) \cdot (T/T_N) = (\alpha + \beta\sqrt{G}) \cdot (T_H - T_A) \cdot A$$

where

V: the voltage of the heating power supplied to the element 17
i: the average current of the heating power
h: the heat-transfer coefficient of the element 17
A: the heat radiation area of the element 17
$T_H$: the temperature of the element 17
$T_A$: the air temperature
$R_H$: the resistance of the element 17
G: the air flow rate
io: the instantaneous current upon energization of the element 17

As is apparent from the equation just given above, the pulse width T is given as follows:

$$T \propto (\alpha + \beta\sqrt{G})/N \quad (1)$$

where $\alpha$ and $\beta$: the constants
N: the number of rotations of the engine 11 per unit of time.

The intake air flow rate per revolution G/N of the engine 11 is derived from the pulse width T of the signal given above, and the injection time is calculated by the unit 18 in proportion to the intake air flow rate G/N. When the unit intake air flow rate G/N and hence the injection time is to be calculated in the manner described above, a control program of the microcomputer is complicated.

Figure 6:
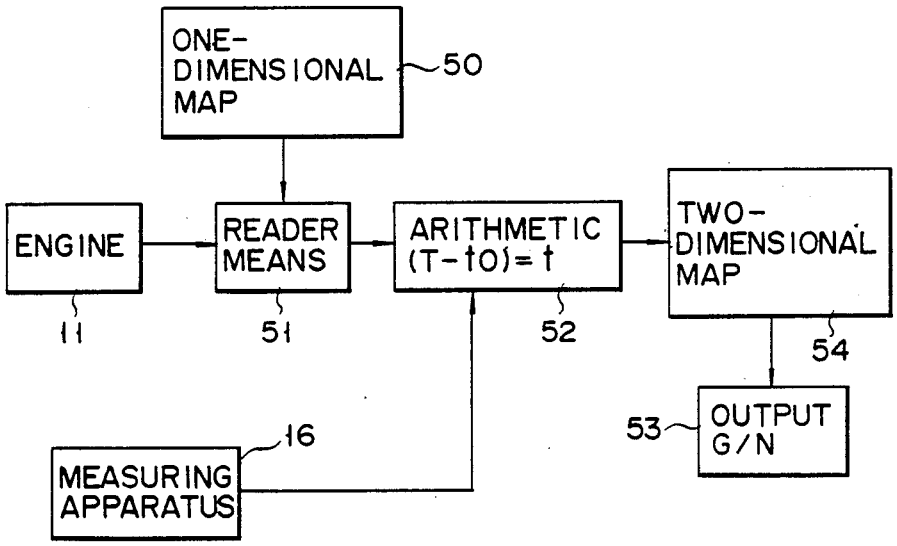
FIG. 6 is a block diagram for explaining a means for calculating an intake air flow rate per revolution G/N of the engine.

According to the present invention, the rate G/N can be calculated by a simple means with high precision. More particularly, a means will be exemplified wherein the rate G/N is calculated using N and the pulse width T of the pulse signal from the device 16, as shown in FIG. 6. The pulse width data t0 is read out by a reader means 51 from a one-dimensional map 50 in accordance with N. The data t0 read by the means 51 is supplied to an arithmetic means 52 together with the pulse width T which performs a calculation of "T"−t0=t", and the data G/N is read out by a reader means 53 from a two-dimensional map 54 in response to the calculated data t.

Figure 7:
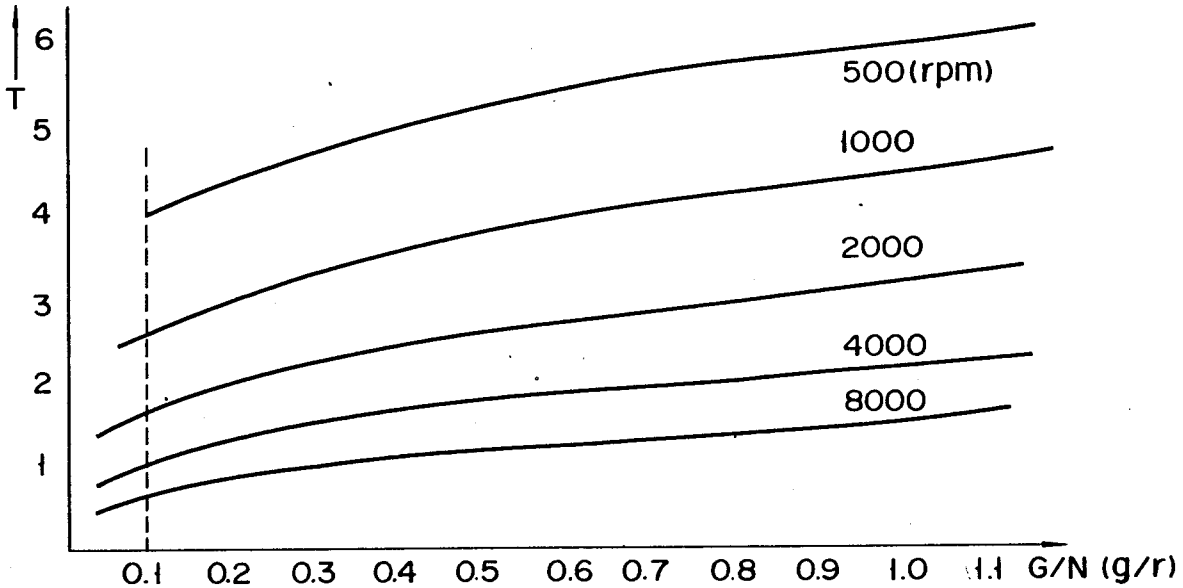
FIG. 7 is a graph of a one-dimensional map showing a relationship between a pulse width T of an output signal from the air flow rate measuring apparatus and the intake air flow rate per revolution G/N of the engine.

The relationship between the pulse width T of the output signal from the device 16 and the rate G/N is shown in FIG. 7. However, when the rate G/N is calculated using the two-dimensional map representing the above relationship, the axis along which the pulse width T is plotted and the axis along which N is plotted must have a high resolution. Under this condition, a map must store a great amount of data, and the read access of the map becomes complicated.

Figure 9:
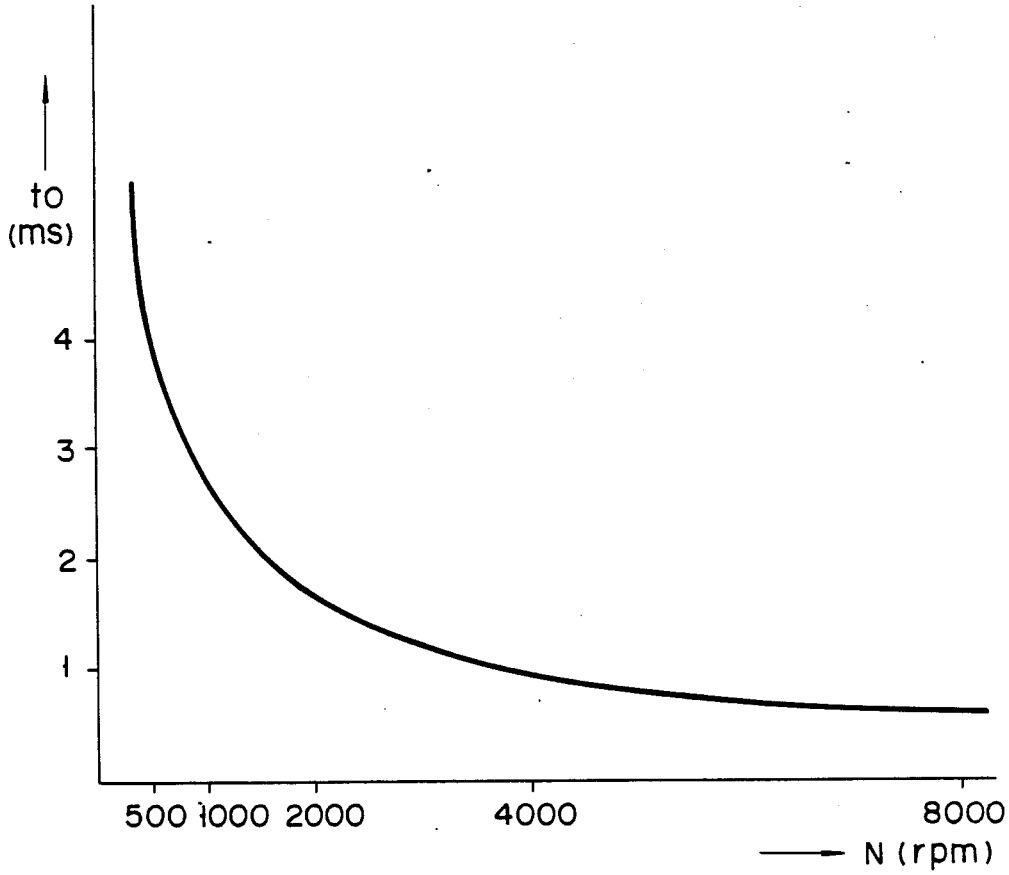
FIG. 9 is a graph of a one-dimensional map for explaining the relationship between the number of engine rotations per unit of time, N at a specified G/N and the pulse width t0 of the corresponding air flow rate signal.

In order to resolve the above problem, the pulse width t0 as a function of the rate G/N using as a parameter N at a point (e.g., G/N=0.1 g/r) which is not associated with actual engine control is stored in the one-dimensional map in FIG. 9.

Figure 8:
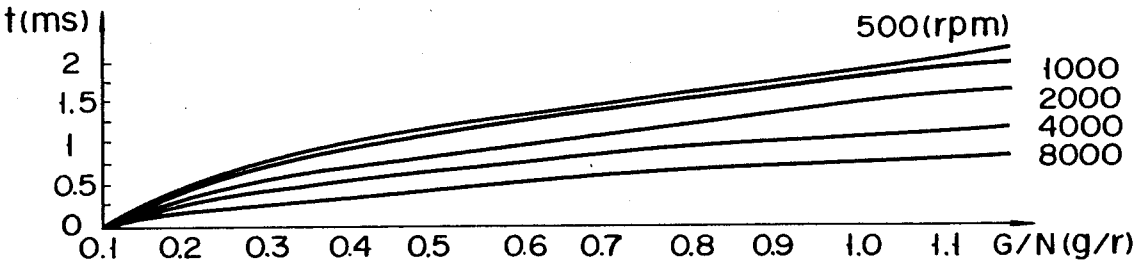
FIG. 8 is a graph showing a two-dimensional map for deriving the intake air flow rate per revolution G/N of the engine.

When the t0 values are read out from the one-dimensional map in response to the respective values of N and are subtracted from the corresponding curves in FIG. 7, the time durations t are zero at the specific rate G/N of 0.1 g/r, as shown in FIG. 8. FIG. 8 shows a two-dimensional map showing the relationship between "T−t0=t" and G/N by using N as a parameter.

Figure 10:
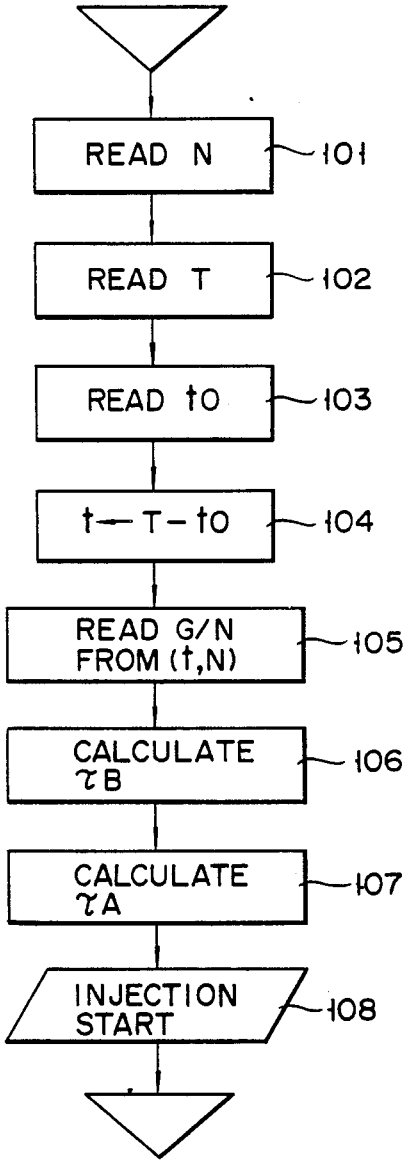
FIG. 10 is a flow chart for explaining a calculation of the fuel injection quantity in accordance with the output signal from the air flow rate measuring unit.

FIG. 10 is a flow chart for explaining the engine control using the above-mentioned one- and two-dimensional maps. For example, when the fuel injection quantity is to be calculated, an interrupt instruction is generated in response to the ignition primary signal in synchronism with the rotation of the engine 11.

In this interrupt routine, N, the number of rotations of the engine 11 per unit of time, is read in step 101. In step 102, a pulse width T is read from the output signal from the device 16. In step 103, the pulse width t0 is read out from the one-dimensional map of FIG. 9 in accordance with N. In step 104, a calculation "T−t0=t" is performed using the pulse widths T and t0.

When the time duration t is thus calculated, the rate G/N corresponding to the data t and N is read out from the two-dimensional map of FIG. 7 in step 105.

In the two-dimensional map, various values of N, (i.e., 500, 625, 750, 1,000, 1,250, 1,500, 2,000, 2,500, 3,000, 4,000, 5,000, 6,000 and 8,000 rpm) are plotted along the axis. The time durations t (=T−t0), i.e., 0, 0.1, 0.2, 0.3, 0.4, 0.5, 0.7, 0.9, 1.1, 1.3, 1.5, 1.9 and 2.3 ms are plotted along the axis thereof.

When the rate G/N is derived in correspondence with the output signal from the device 16, a basic fuel injection quantity $\tau_B$ is calculated in step 106, where $\tau_B$ is given such that $\tau_B = K \times (G/N)$. The data $\tau_B$ is multiplied with correction coefficients derived from a cooling water temperature, an oxygen concentration in the exhaust gas, a throttle opening, a battery voltage and the like. As a result, a injection valve opening time $\tau_A$ (corresponding to the fuel injection quantity) is calculated, and an injection start instruction is supplied to the unit injectors in step 108.

In the above embodiment, the heating power having a reference voltage is supplied to the element 17. However, heating power having a constant current can be supplied to the element 17. The element 17 is heated at a temperature rise rate corresponding to an increase in current of the heating power, and the predetermined temperature of the element 17 is detected. Upon detection of the predetermined temperature of the element 17, a measurement output signal having a predetermined pulse width T is provided in the same manner as in the above embodiment.

In the embodiment described above, the intake condition measuring device detects the intake air flow rate G/N, and based on this intake air flow rate G/H, the fuel injection quantity is calculated. However, the intake condition measuring device may be adapted to detect the intake air pipe pressure P. In this case, the fuel injection quantity ($\tau_B(=K \times f(P, N))$) is obtained from the intake air pipe pressure P and the engine rotation number N by a method similar to that used in the above embodiment.

Figure 11:
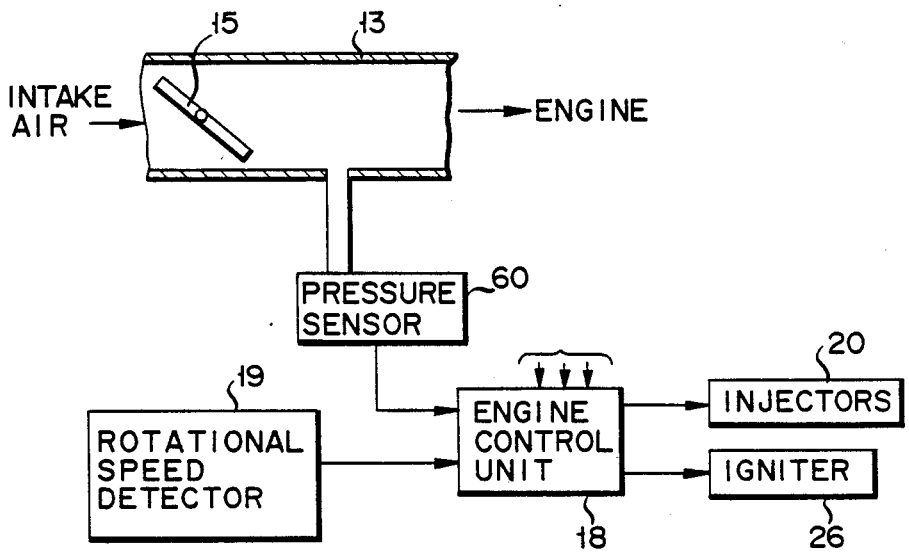
FIG. 11 is a diagram of an intake condition measuring device.

As shown in FIG. 11, the intake condition measuring device can be a pressure sensor 60 provided in the intake pipe 13 at a location downstream of the throttle valve 15 for measuring the pressure of the air flowing through the intake pipe 13. The sensor 60 would supply an intake air pressure signal to the engine control unit 18. The unit 18, in turn, applies a signal representing the calculated fuel injection quantity to the injector 20, and an instruction signal to the igniter 26.

The intake air pressure signal from the sensor 60 is treated in the same manner as the intake air flow rate signal described above, to obtain the control data G/N, i.e., the intake air flow rate per revolution of the engine.

What is claimed is:

1. An engine control apparatus, comprising:

an intake condition measuring device for measuring a parameter representing an intake air flow condition and generating a measurement output signal (T);

one-dimensional memory map means for storing specific intake condition data (t0) as a function of an engine speed N, each intake condition data representing a specific value of an intake condition of an engine;

means for subtracting said specific intake condition data (t0) from said measurement output signal (T) to calculate an intake condition (t);

two-dimensional map memory means for storing a predetermined correspondence between control data (G/N) and intake conditions (t) as a function of each of a plurality of preset engine speeds;

control data deriving means for reading out a corresponding control data (G/N) from said two-dimensional memory map which corresponds to a calculated intake condition data (t) calculated by said subtracting means; and engine control data deriving means for calculating a fuel injection quantity on the basis of said control data (G/N).

2. An apparatus according to claim 1, wherein said intake condition measuring device generates an output pulse signal representing a time width (T) corresponding to a measured intake air flow rate.

3. An apparatus according to claim 1, wherein said intake condition measuring device includes:

a heater;

a temperature sensing element having a resistance which varies in response to a change in temperature therefore, said temperature sensing element being located in a path of an intake air flow, and being started with a periodically generated start pulse signal, said heater being heated by heating power which is turned off when said temperature sensing element reaches a specific temperature, and wherein said intake condition measuring device is adapted to generate a measurement output pulse signal having a pulse width (T) corresponding to a time duration of the heating power supplied thereto.

4. An apparatus according to claim 1, wherein said intake condition measuring device generates an output signal representing a time width (T) corresponding to a measured intake air flow rate, and said specific intake condition data (t0) is time width data which represents an intake air flow rate by using an engine rotation number N as a parameter.

5. An apparatus according to claim 1, wherein a specific value of said control data (G/N) in said one-dimensional memory map means falls within a range which is not associated with control of the engine.

6. An apparatus according to claim 5, wherein a specific value of said control data G/N is 0.1.

7. An apparatus according to claim 1, wherein said intake condition measuring device having a temperature sensing element comprises a resistive element which is heated upon reception of heating power and whose resistance changes in accordance with changes in the temperature thereof, said temperature sensing element being arranged inside an intake pipe of the engine and exposed to an intake air flow therein.

8. An apparatus according to claim 1, wherein said intake condition measuring device comprises:

a temperature sensing element having a temperature characteristic and arranged inside an intake pipe;

an auxiliary temperature sensing element arranged in said intake pipe to detect a temperature of intake air;

comparator means for comparing the temperature of said intake air which is detected by (1) said auxiliary temperature sensing element, and (2) said temperature sensing element and for detecting when a difference between said temperatures of said temperature sensing element and said auxiliary temperature sensing element exceeds a predetermined difference;

means for periodically generating a start pulse signal;

means for generating a pulse signal which rises in response to said periodically generated start pulse signal and which falls in response to an output signal from said comparator means;

means for selectively supplying heating power to said temperature sensing element in accordance with a pulse width of the pulse signal; and means for generating the pulse signal as an air flow rate measurement signal.

9. An apparatus according to claim 8, wherein the heating power supplied to said temperature sensing element has a constant voltage regulated by a reference voltage source.

10. An apparatus according to claim 1, wherein said two-dimensional memory map means stores data representing relationships between preset data and the corresponding intake conditions t, the preset data being given in correspondence to engine speeds 500, 625, 750, 1,000, 1,250, 1,500, 2,000, 2,500, 3,000, 4,000, 5,000, 6,000 and 8,000 rpm of the engine.

11. An apparatus according to claim 1, wherein a plurality of read points are plotted along an axis for said intake condition t, one of the points being selected in response to the calculated intake condition t, thereby reading out a corresponding rate G/N from said two-dimensional map.

12. An apparatus according to claim 11, wherein a plurality of read points corresponding to time durations 0, 0.1, 0.2, 0.3, 0.4, 0.5; 0.7, 0.9, 1.1, 1.3, 1.5, 1.9 and 2.3 ms are plotted along an axis for the time duration t.

13. An apparatus according to claim 3, wherein the start pulse used in said intake condition measuring device is generated in synchronism with the rotation of the engine.

14. An apparatus according to claim 1, wherein said intake condition measuring device is an air pressure measuring device for measuring the pressure of the air flowing through an intake pipe.

15. A method of controlling fuel injection quantity in an engine, comprising the steps of:

storing a one dimensional data map showing a relationship between specific intake condition data $t_0$ and engine speed N;

storing a two dimensional data map showing air flow rate per revolution G/N as a function of intake condition t and engine speed N;

determining engine speed N;

determining air flow T;

reading specific intake condition data $t_0$ from the one dimensional map using the determined engine speed N;

calculating an intake condition t from the already known values of air flow T and intake condition data $t_0$, as $t=T-t_0$;

reading from the two dimensional map air flow rate per revolution G/N using the calculated value of t and the determined value of N; and determining a parameter representing a fuel injection quantity from the air flow rate per revolution G/N.

* * * * *